US009190757B2

(12) United States Patent
Kiyooka et al.

(10) Patent No.: US 9,190,757 B2
(45) Date of Patent: Nov. 17, 2015

(54) CONNECTOR, CONNECTOR ASSEMBLY, AND CABLE FOR USE IN THE CONNECTOR ASSEMBLY

(71) Applicant: PANASONIC CORPORATION, Osaka (JP)

(72) Inventors: Takashi Kiyooka, Mie (JP); Katsutoshi Tohjo, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 13/942,535

(22) Filed: Jul. 15, 2013

(65) Prior Publication Data

US 2014/0162492 A1 Jun. 12, 2014

(30) Foreign Application Priority Data

Jul. 20, 2012 (JP) ..... 2012-161859

(51) Int. Cl.

| | |
|---|---|
| ***H01R 13/58*** | (2006.01) |
| ***H01R 13/20*** | (2006.01) |
| ***H01R 12/77*** | (2011.01) |
| *H01R 12/88* | (2011.01) |

(52) U.S. Cl.

CPC ..... *H01R 13/20* (2013.01); *H01R 12/774* (2013.01); *H01R 12/778* (2013.01); *H01R 12/88* (2013.01)

(58) Field of Classification Search

CPC ... H01R 12/774; H01R 13/20; H01R 23/6886
USPC ..... 439/346, 492, 629–637, 924.1, 951; 3/346, 492, 629–637, 924.1, 951
See application file for complete search history.

(56) References Cited

U.S. PATENT DOCUMENTS

| | | | | |
|---|---|---|---|---|
| 4,298,237 | A * | 11/1981 | Griffith et al. | 439/60 |
| 4,303,291 | A * | 12/1981 | Dines | 29/843 |
| 5,236,372 | A * | 8/1993 | Yunoki et al. | 439/260 |
| 5,463,210 | A * | 10/1995 | Imura | 235/441 |
| 6,447,340 | B1 * | 9/2002 | Wu | 439/660 |
| 7,238,044 | B2 * | 7/2007 | Uchida et al. | 439/492 |
| 7,255,586 | B2 * | 8/2007 | Okada | 439/346 |
| 8,113,887 | B2 * | 2/2012 | Osawa et al. | 439/637 |
| 8,529,302 | B2 * | 9/2013 | Ogura et al. | 439/795 |
| 2004/0023551 | A1 * | 2/2004 | Suzuki et al. | 439/495 |
| 2007/0077809 | A1 * | 4/2007 | Takashita | 439/492 |
| 2008/0137277 | A1 * | 6/2008 | Mundt | 361/683 |
| 2013/0330973 | A1 * | 12/2013 | Ashibu | 439/629 |
| 2014/0162492 | A1 * | 6/2014 | Kiyooka et al. | 439/492 |

FOREIGN PATENT DOCUMENTS

JP 2011-222273 A 11/2011

* cited by examiner

*Primary Examiner* — James Harvey
(74) *Attorney, Agent, or Firm* — McDermott Will & Emery LLP

(57) ABSTRACT

A connector 10 includes: a housing 30 into which a cable 20 is to be inserted; first contacts 40 housed in the housing 30 and having contact portions 46 with a short effective fitting length; and second contacts 50 housed in the housing 30 and having contact portions 56 with a long effective fitting length. Then, the first contacts 40 are arranged on both ends in a width direction Y of the housing 30, and the contact portions 56 with the long effective fitting length of the second contacts 50 arranged so as to adjoin insides in the width direction Y of the first contacts 40 arranged on both ends, are engaged with engagement portions 22 of the cable 20.

7 Claims, 8 Drawing Sheets

CONNECTOR, CONNECTOR ASSEMBLY, AND CABLE FOR USE IN THE CONNECTOR ASSEMBLY

CROSS REFERENCE TO RELATED APPLICATIONS

This application is based upon and claims the benefit of priority from prior Japanese Patent Application P2012-161859 filed on Jul. 20, 2012; the entire contents of which are incorporated by reference herein.

BACKGROUND OF THE INVENTION

The present invention relates to a connector, a connector assembly, and a cable for use in the connector assembly.

Heretofore, as disclosed in Japanese Patent Laid-Open Publication No. 2011-222273 (hereinafter, referred to as Patent Literature 1), as a connector, there is known one, which includes: a plurality of contacts individually brought into contact with a plurality of conductors formed on a cable such as an FPC and an FFC; a housing that houses the plurality of contacts therein; and a lever rotatably attached to the housing.

In this Patent Literature 1, a locking mechanism for retention of the cable inserted into the housing is provided. Specifically, locking holes are formed on both ends in a width direction of the cable, and meanwhile, holding terminals which have locking protrusions to be engaged with the locking holes are provided on both ends in a width direction of the housing, and the locking protrusions are inserted into the locking holes, whereby the cable is prevented from coming out.

SUMMARY OF THE INVENTION

However, in the above-described conventional technology, independently of the contacts, the holding terminals are provided on both ends in the width direction of the housing, which results in cost increase by that amount.

In this connection, it is an object of the present invention to obtain a connector and a connector assembly, which are capable of suppressing coming out of a cable from the connector while reducing cost, and to obtain a cable for use in the connector assembly.

A first feature of the present invention is a connector including: a housing into which a cable is to be inserted; first contacts housed in the housing and having contact portions with a short effective fitting length; and second contacts housed in the housing and having contact portions with a long effective fitting length, and is summarized as that the first contacts are arranged on both ends in a width direction of the housing, that engagement portions are provided on the cable, and that the contact portions with the long effective fitting length of the second contacts arranged so as to adjoin insides in the width direction of the first contacts arranged on both ends can be engaged with the engagement portions.

A second feature of the present invention is summarized as that the first contacts and the second contacts are alternately arranged in the width direction of the housing.

A third feature of the present invention is summarized as that step difference portions are provided on conductors formed in the cable, and the contact portions with the short effective fitting length of the first contacts arranged on both ends can be engaged with the step difference portions.

A fourth feature of the present invention is summarized as that the engagement portions are through holes or notches.

A fifth feature of the present invention is summarized as that the conductors are patterned on the cable surface, and the step difference portions are formed by partially removing the patterned conductors.

A sixth feature of the present invention is a connector assembly, summarized as that the cable having the engagement portions formed is inserted into the housing of the connector.

A seventh feature of the present invention is a cable, summarized as the cable to be used in the connector assembly.

DETAILED DESCRIPTION OF THE PREFERRED EMBODIMENTS

Figure 1:
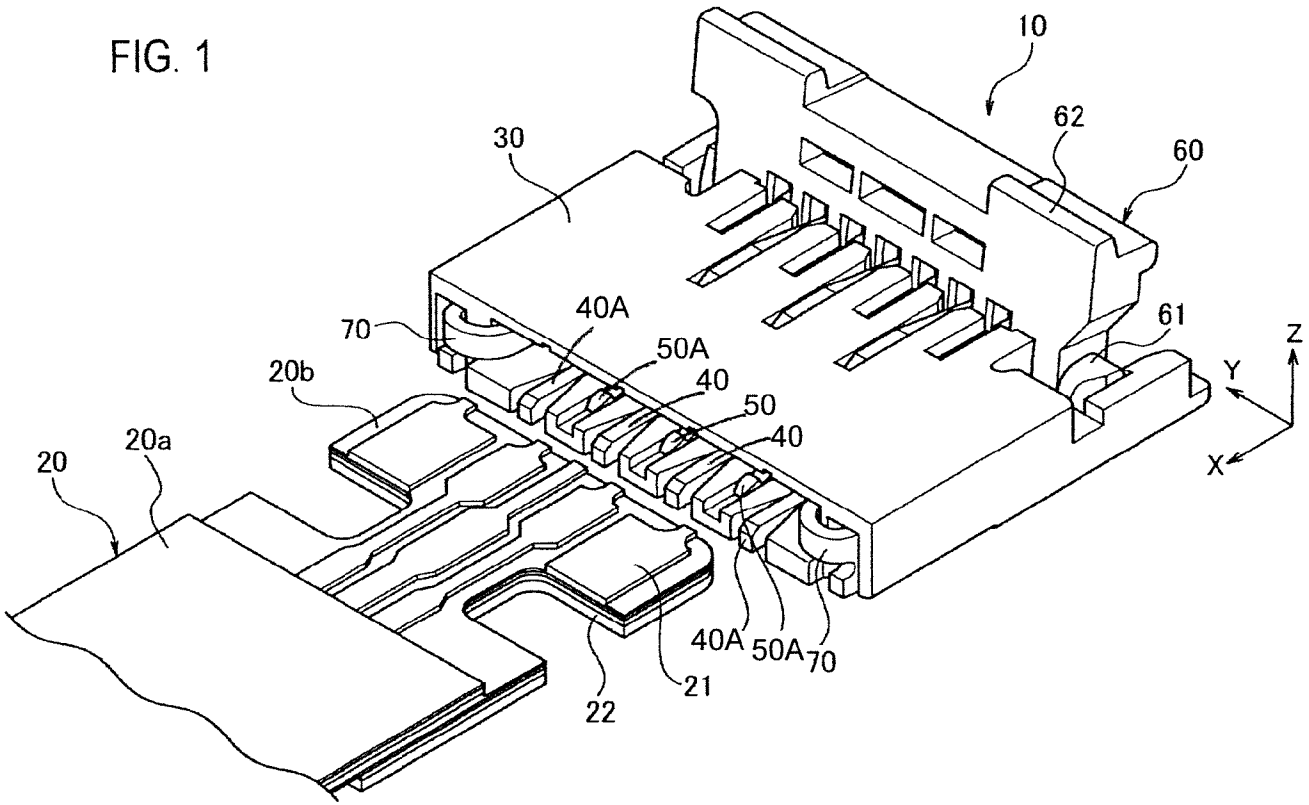
FIG. 1 is a perspective view showing a connector and a cable according to a first embodiment of the present invention.

A description in detail of embodiments of the present invention is made below while referring to the drawings. In the following, the description is made on the assumption that a cable insertion/removal direction is a front-back direction X, that a longitudinal direction of a housing (that is, an arrayed direction of contacts: a direction perpendicular to the cable insertion/removal direction and a thickness direction) is a width direction Y, and that the thickness direction of the housing (that is, a thickness direction of the inserted cable) is a vertical direction Z. Moreover, a direction for the cable to move when inserting the cable is defined as forward, and a direction for the cable to move when removing the cable is defined as backward, and the vertical direction is defined such that an upper side, in a state where the connector is arranged so that a lever mounted on the housing can be located on an upper portion, as upward.

Moreover, similar constituents are included in the following plurality of embodiments and modification examples thereof. Hence, in the following, common reference numerals are assigned to these similar constituents, and in addition, a redundant description is omitted.

First Embodiment

As shown in FIG. 1, a connector 10 according to this embodiment includes an insulative housing 30 into which a sheet-like cable 20 having a front surface and a back surface, such as an FPC and an FFC, is to be inserted.

On an insertion end portion 20*b* continuously provided on a body portion 20*a* of this sheet-like cable 20, a plurality of conductors 21 are exposed at a predetermined pitch in the width direction Y. Then, regions of the conductors 21, on which contact point portions (fixed-side contact point portions 44*a*, movable-side contact point portions 46*a*) of first contacts 40 and contact point portions (fixed-side contact point portions 54*a*, movable-side contact point portions 56*a*) of second contacts 50 are to abut, are arranged in a zigzag state in front and back two lines (refer to FIG. 1). Note that the conductors 21 are patterned on upper and back surfaces of the insertion end portion 20*b* so as to have substantially the same shape, and basically, are electrically connected to conductors (not shown) formed in the body portion 20*a*. Then, inside the housing 30, a plurality of the conductive first contacts 40 and second contacts 50, which are to be conductively connected to the conductors 21 of the cable 20, are arrayed at a predetermined pitch in the width direction Y.

Moreover, an insulative lever 60 is rotatably attached to the housing 30. Specifically, the lever 60 is attached to the housing 30 so as to be rotatable between an open position (a state shown in FIG. 1), at which the cable 20 can be inserted into the housing 30, and a closed position (a state shown in FIG. 2), at which the cable 20 inserted into the housing 30 is sandwiched between the first contacts 40 and the second contacts 50.

The housing 30 is formed of an insulating material such as synthetic resin, and on the rear of this housing 30 (that is, a left side in FIG. 5 and FIG. 6: a removal side in the cable insertion/removal direction), a bag-like cable receiving portion 31, into which the cable 20 is to be inserted from the rear, is formed in a substantially intermediate portion thereof in the vertical direction Z.

This cable receiving portion 31 is defined by a ceiling wall portion 32, a bottom wall portion 33, and both-side wall portions 34 and 34 formed on both ends in the width direction Y of the rear of the housing 30, and is open to the rear.

Moreover, as shown in FIG. 1, on both ends in the width direction Y of the front of the housing 30, front wall portions (a pair of longitudinal wall portions) 34*d* and 34*d*, which are located in the outside in the width direction Y of the side wall portions 34 and 34, are formed, and a bottom wall portion 34*e* is formed in the inside of the front wall portions 34*d* and 34*d*. Then, on the front of the housing 30, a lever mounting portion 35 is formed, which is defined by the front wall portions 34*d* and 34*d* and is open upward and frontward. The lever 60 is rotatably mounted on this lever mounting portion 35.

Furthermore, on both end portions in the width direction Y of the lever mounting portion 35, bearing portions 35*a* open upward and frontward are formed to oppose each other in the width direction Y of the housing 30.

Moreover, the lever 60 is a plate-like member capable of being housed in the lever mounting portion 35 of the housing 30, and this lever 60 is also formed of an insulating material such as synthetic resin. Then, as shown in FIG. 1, pivot shafts 61 are individually protruded from base end sides of both end surfaces in the width direction Y of the lever 60. Moreover, a body of the lever 60 serves as an operation portion 62 for performing opening/closing operations for the lever 60.

In this embodiment, by mounting, from above the housing 30, the pivot shafts 61 on both ends in the width direction Y of the lever 60 on the bearing portions 35*a* on both ends in the width direction Y of the housing 30, the lever 60 is attached to the lever mounting portion 35 of the housing 30 so as to be openable/closable (rotatable) (refer to FIG. 1).

Figure 4:
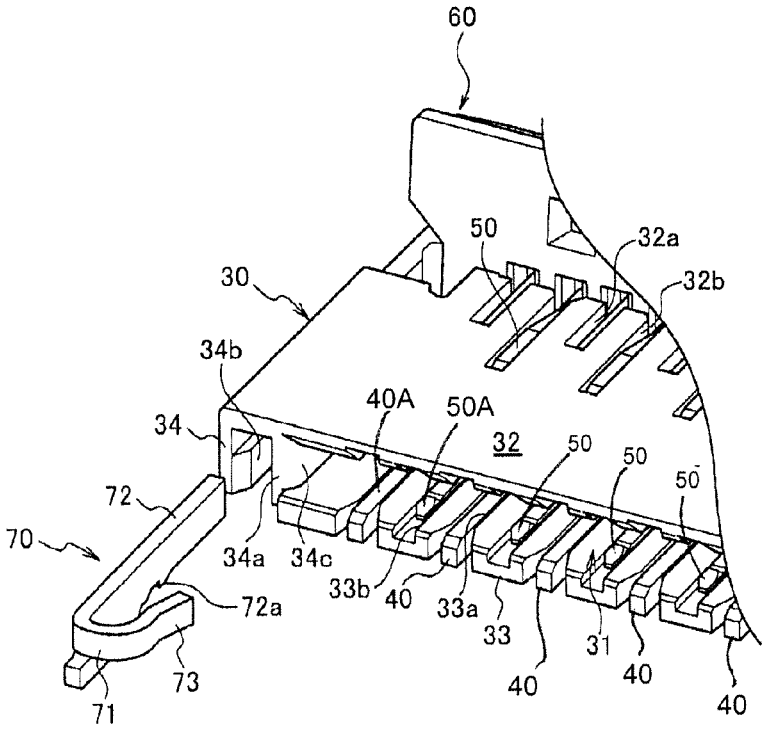
FIG. 4 is an exploded perspective view showing a protection member of the connector according to the first embodiment of the present invention.

Moreover, as shown in FIG. 4, on the both-side wall portions 34 and 34 which define the cable receiving portion 31 into which the cable 20 is to be inserted, protection members 70 for protecting front surfaces 34*a* and 34*a* of the both-side wall portions 34 and 34 are provided.

As shown in FIG. 4, each of the protection members 70 has a linear attachment portion 72, and a portion, which is curved into a U-shape as a result of folding back a tip end portion of this attachment portion 72 into a U-shape, serves as a guard portion 71 that protects the front surface 34*a* of the side wall portion 34. The guard portion 71 is formed integrally with the attachment portion 72 by machining a part (tip end portion) of the attachment portion 72. Note that, preferably, the protection member 70 is formed of a metal material, which is excellent as a whole in abrasion resistance, for example, phosphor bronze, brass, titanium copper, beryllium copper, stainless steel, or the like.

Meanwhile, in each of the both-side wall portions 34 and 34 is formed an attachment hole 34*b* into which the attachment portion 72 of the protection member 70 is to be inserted. Then, by inserting the attachment portion 72 into this attachment hole 34*b*, the guard portion 71 of the U-shaped protection member 70 covers the front surface (tip end surface) 34*a* of the side wall portion 34.

Moreover, on a lower-side center portion of the attachment portion 72 is provided an engagement protruding portion 72*a*, and this engagement protruding portion 72*a* prevents the attachment portion 72 from coming out.

Furthermore, on the protection member 70, a cable holding portion 73 is provided, which is obtained by extending a tip end portion of the guard portion 71 to a depth side (frontward) of the cable receiving portion 31, for applying a constant pressing/urging force to both sides of the cable 20. As described above, each of the protection members 70 includes the guard portion 71, the attachment portion 72, and the cable holding portion 73, and has a fishhook shape as a whole.

Moreover, in an inside in the width direction Y of the cable receiving portion 31 is formed a groove portion 34*c* which serves as a storage space of each cable holding portion 73.

In addition, the cable holding portion 73 allows a tip end portion thereof to be bent toward the inside in the width direction Y of the cable receiving portion 31, and is thereby configured to be capable of applying urging force to press the side surface of the inserted cable 20 by elastic force inherent in the guard portion 71 curved into the U-shape.

Thus, in this embodiment, the protection members 70 are provided, whereby damage to the side wall portions 34 can be suppressed more surely even in the case where the cable 20 is inserted obliquely.

Figure 2:
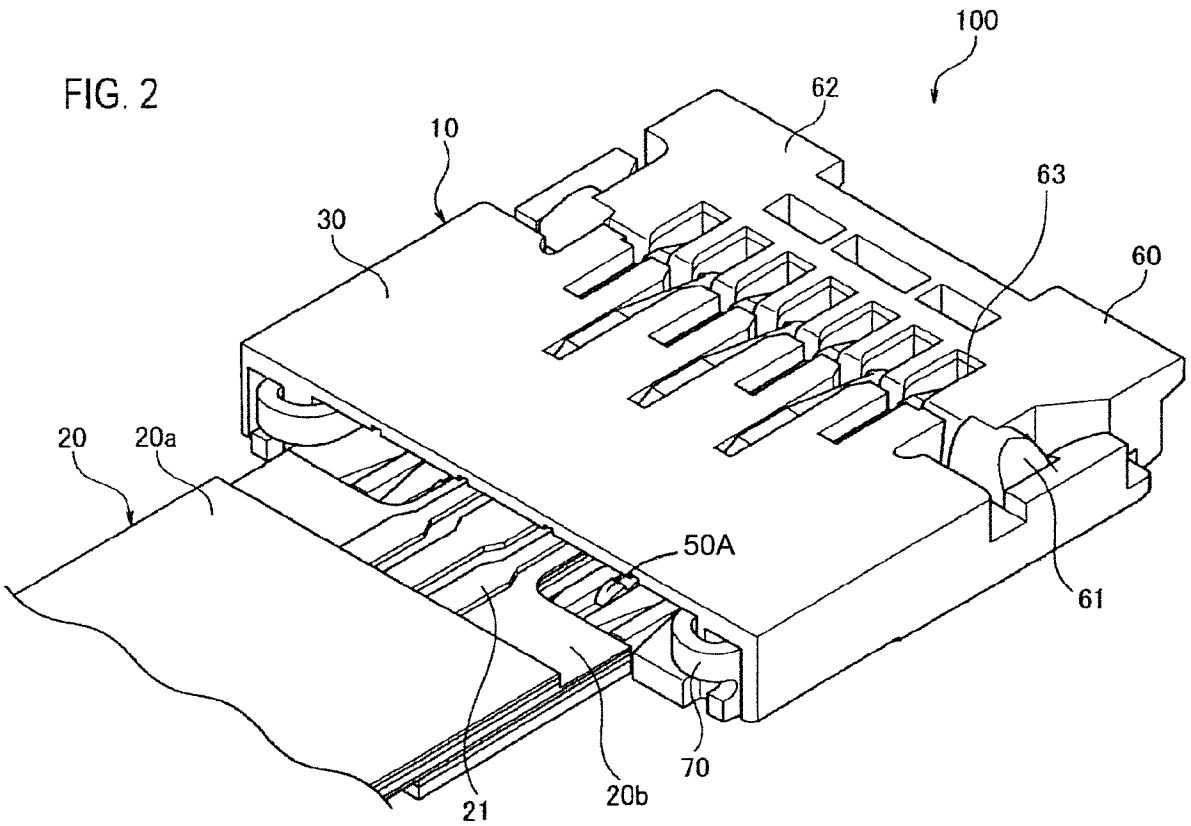
FIG. 2 is a perspective view showing a connector assembly according to the first embodiment of the present invention.
Figure 3:
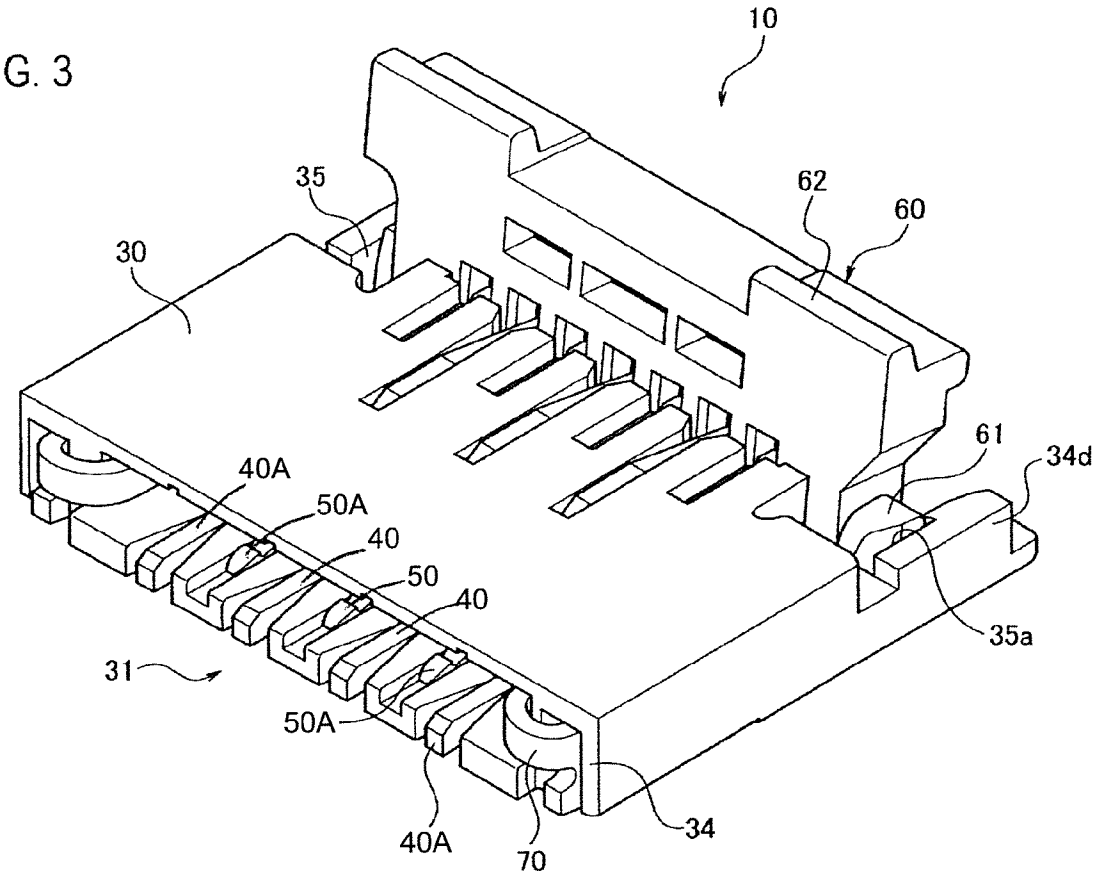
FIG. 3 is a perspective view showing the connector according to the first embodiment of the present invention.

Moreover, as mentioned above, the lever 60 is attached to the housing 30 so as to rotationally move from the open position shown in FIG. 1 to the closed position shown in FIG. 2.

Figure 5:
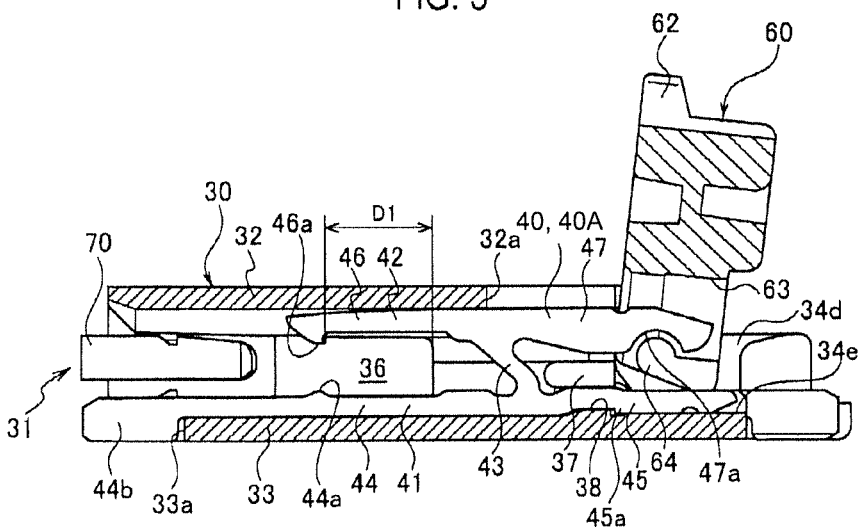
FIG. 5 is a cross-sectional view showing an arranged state of a first contact of the connector according to the first embodiment of the present invention.
Figure 6:
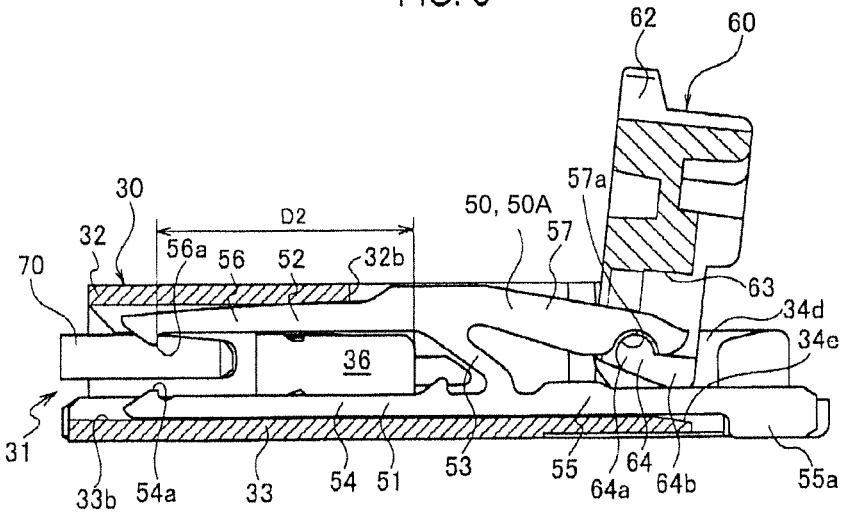
FIG. 6 is a cross-sectional view showing an arranged state of a second contact of the connector according to the first embodiment of the present invention.

Then, the lever 60, when located at the open position, rises in a rearward-tilted erected attitude from the lever mounting portion 35 of the housing 30, and substantially a half of the front of the lever mounting portion 35 is made open above the housing 30 (refer to FIG. 5 and FIG. 6). At this time, the cable 20 can be inserted into the cable receiving portion 31 of the housing 30.

Meanwhile, the lever 60, when located at the closed position, takes a substantially horizontal attitude, is housed in the lever mounting portion 35 of the housing 30, and is configured to sandwich the cable 20, which is inserted into the cable receiving portion 31, by the first contacts 40 and the second contacts 50.

Pluralities of the first contacts 40 and the second contacts 50 are arrayed in the width direction Y of the housing 30, and the first contacts 40 and the second contacts 50 are formed by stamping a thin metal sheet.

In this embodiment, the first contacts 40 and the second contacts 50 are alternately provided in the width direction Y of the housing 30, and the first contacts 40A are provided on both ends in the width direction Y of the housing 30.

Note that the first contacts 40 are inserted from the rear into the housing 30, followed by fixing and holding (refer to FIG. 5), and the second contacts 50 are inserted from the front into the housing 30, followed by fixing and holding (refer to FIG. 6).

In this embodiment, in the housing 30, a plurality of housing portions 36, which house the pluralities of first contacts 40 and second contacts 50 therein, are provided so as to penetrate the housing 30 in the front-back direction X. Furthermore, on the ceiling wall portion 32, first groove portions 32*a* and second groove portions 32*b*, which are extended in the front-back direction X, are formed, while on the bottom wall portion 33, first groove portions 33*a* and second groove portions 33*b* are formed which are extended in the front-back direction X. Then, into each of the housing portions 36, one first contact 40 is inserted from the rear, and one second contact 50 is inserted from the front. At this time, the first contact 40 is sandwiched between each first groove portion 32*a* of the ceiling wall portion 32 and each first groove portion 33*a* of the bottom wall portion 33. Meanwhile, the second contact 50 is sandwiched between each second groove portion 32*b* of the ceiling wall portion 32 and each second groove portion 33*b* of the bottom wall portion 33.

Moreover, in each housing portion 36 that houses the first contact 40 therein, a wall portion 37 is formed which defines an insertion hole 38 into which a terminal arm portion 45 to be described later is to be inserted. The terminal arm portion 45 is press-fitted into the insertion hole 38, whereby the first contact 40 is fixed and held to the housing 30. As shown in FIG. 5, the first contact 40 includes: a stick-like fixed-side contact portion 41 extended in the front-back direction X in the vicinity of the bottom wall portion 33; and a stick-like movable-side contact portion 42, which is extended in the front-back direction X in the vicinity of the ceiling wall portion 32 and is opposite to the fixed-side contact portion 41 in the vertical direction (thickness direction of the housing 30: thickness direction of the cable 20) Z. Then, with regard to the fixed-side contact portion 41 and the movable-side contact portion 42, intermediate portions thereof in the front-back direction (longitudinal direction) X are coupled to each other by a coupling spring portion 43, and the fixed-side contact portion 41 and the movable-side contact portion 42 are formed into a substantially laid-H-shape.

As shown in FIG. 5, the fixed-side contact portion 41 includes: a fixed-side arm portion (contact portion) 44 extended along the bottom wall portion 33 toward the rear side (one side of the fixed-side contact portion 41) in the front-back direction X; and a terminal arm portion 45 extended along the bottom wall portion 33 toward the front side (other side of the fixed-side contact portion 41) in the front-back direction X.

Then, on a substantially intermediate portion of the fixed-side arm portion (contact portion) 44, a fixed-side contact point portion 44*a* that protrudes upward (toward the inserted cable 20) is formed, and this fixed-side contact point portion 44*a* is brought into contact with the conductor 21 of the cable 20.

Moreover, on a tip end portion of the fixed-side arm portion (contact portion) 44 is formed a stopper 44*b* that protrudes downward. Then, this stopper 44*b* regulates a maximum insertion amount of the first contact 40 into the housing 30 at the time when the first contact 40 is inserted into the housing portion 36. Moreover, this stopper 44*b* also serves as a soldered portion for surface mounting when mounting the connector 10 on a circuit board (not shown).

Furthermore, the terminal arm portion 45 is provided with a protruding portion 45*a* that protrudes downward, and the terminal arm portion 45 is press-fitted into the insertion hole 38, and the protruding portion 45*a* is allowed to enter the bottom wall portion 33, whereby the first contact 40 is fixed and held to the housing 30.

Moreover, as shown in FIG. 5, the movable-side contact portion 42 includes: a movable-side arm portion (contact portion) 46 extended along the ceiling wall portion 32 toward the rear side (one side of the movable-side contact portion 42) in the front-back direction X; and a spring portion 47 extended along the ceiling wall portion 32 toward the front side (the other side of the movable-side contact portion 42) in the front-back direction X.

Then, on a tip end portion of the movable-side arm portion (contact portion) 46 is formed a movable-side contact point portion 46*a* that protrudes downward (toward the inserted cable 20), and this movable-side contact point portion 46*a* is brought into contact with the conductor 21 of the cable 20.

In this embodiment, when the lever 60 is located at the open position, a distance between the fixed-side contact point portion 44*a* and the movable-side contact point portion 46*a* has substantially the same size as the thickness of the cable 20. Moreover, when the lever 60 is located at the closed position in a state where the cable 20 is not inserted, the distance between the fixed-side contact point portion 44*a* and the movable-side contact point portion 46*a* is set smaller than the thickness of the cable 20. Hence, when the lever 60 is located at the open position, the cable 20 can be inserted into the housing 30, and when the lever 60 is located at the closed position, the fixed-side contact point portion 44*a* and the movable-side contact point portion 46*a* crimp the cable 20, and the first contact 40 sandwiches the cable 20.

Moreover, on a lower surface of the spring portion 47 is formed a substantially circular-arc cam surface 47*a*, with which a later-described cam portion 64 of the lever 60 is to be brought into sliding contact.

Then, the coupling spring portion 43 has spring properties, and is made elastically deflectable. In this embodiment, the coupling spring portion 43 couples the fixed-side contact portion 41 and the movable-side contact portion 42 to each other in a state of being tilted upward and backward. Then, when the front end of the spring portion 47 and the front end of the terminal arm portion 45 are relatively separated from each other, so that the coupling spring portion is elastically deflected and an interval between the movable-side arm portion (contact portion) 46 of the movable-side contact portion 42 and the fixed-side arm portion (contact portion) 44 of the fixed-side contact portion 41 is made to become smaller.

Meanwhile, as shown in FIG. 6, the second contact 50 includes: a stick-like fixed-side contact portion 51 extended in the front-back direction X in the vicinity of the bottom wall portion 33; and a stick-like movable-side contact portion 52, which is extended in the front-back direction X in the vicinity of the ceiling wall portion 32 and is opposite to the fixed-side contact portion 51 in the vertical direction (thickness direction of the housing 30: thickness direction of the cable 20) Z. Then, with regard to the fixed-side contact portion 51 and the movable-side contact portion 52, intermediate portions thereof in the front-back direction (longitudinal direction) X are coupled to each other by a coupling spring portion 53, and the fixed-side contact portion 51 and the movable-side contact portion 52 are formed into a substantially laid-H-shape.

As shown in FIG. 6, the fixed-side contact portion 51 includes: a fixed-side arm portion (contact portion) 54 extended along the bottom wall portion 33 toward the rear side (one side of the fixed-side contact portion 51) in the front-back direction X; and a terminal arm portion 55 extended along the bottom wall portion 33 toward the front side (the other side of the fixed-side contact portion 51) in the front-back direction X.

Then, on a tip end portion of the fixed-side arm portion (contact portion) 54 is formed a fixed-side contact point portion 54*a* that protrudes upward (toward the inserted cable 20), and this fixed-side contact point portion 54*a* is brought into contact with the conductor 21 of the cable 20.

Moreover, on a tip end portion of the terminal end portion 55 is formed a stopper 55*a* that protrudes downward. Then, this stopper 55*a* regulates a maximum insertion amount of the second contact 50 into the housing 30 at the time when the second contact 50 is inserted into the housing portion 36. Moreover, this stopper 55*a* also serves as a soldered portion for the surface mounting when mounting the connector 10 on the circuit board (not shown).

Furthermore, as shown in FIG. 6, the movable-side contact portion 52 includes: a movable-side arm portion (contact portion) 56 extended along the ceiling wall portion 32 toward the rear side (one side of the movable-side contact portion 52) in the front-back direction X; and a spring portion 57 extended along the ceiling wall portion 32 toward the front side (other side of the movable-side contact portion 52) in the front-back direction X.

Then, on a tip end portion of the movable-side arm portion (contact portion) 56 is formed a movable-side contact point portion 56*a* that protrudes downward (toward the inserted cable 20), and this movable-side contact point portion 56*a* is brought into contact with the conductor 21 of the cable 20.

In this embodiment, when the lever 60 is located at the open position, a distance between the fixed-side contact point portion 54*a* and the movable-side contact point portion 56*a* has substantially the same size as the thickness of the cable 20. Moreover, when the lever 60 is located at the closed position in the state where the cable 20 is not inserted, the distance between the fixed-side contact point portion 54*a* and the movable-side contact point portion 56*a* is set smaller than the thickness of the cable 20. Hence, when the lever 60 is located at the open position, the cable 20 can be inserted into the housing 30, and when the lever 60 is located at the closed position, the fixed-side contact point portion 54*a* and the movable-side contact point portion 56*a* crimp the cable 20, and the second contact 50 sandwiches the cable 20.

Moreover, on a lower surface of the spring portion 57 is formed a substantially circular-arc cam surface 57*a*, with which the later-described cam portion 64 of the lever 60 is to be brought into sliding contact.

Furthermore, the coupling spring portion 53 has spring properties and is made elastically deflectable. In this embodiment, the coupling spring portion 53 couples the fixed-side contact portion 51 and the movable-side contact portion 52 to each other in a state of being tilted upward and backward. Then, when the spring portion 57 is deflected so that the front end of the spring portion 57 and the front end of the terminal arm portion 55 are opened relatively to each other, then the coupling spring portion 53 is elastically deflected, and an interval between the movable-side arm portion (contact portion) 56 of the movable-side contact portion 52 and the fixed-side arm portion (contact portion) 54 of the fixed-side contact portion 51 is made smaller.

Moreover, in this embodiment, as shown in FIG. 5 and FIG. 6, an arm length (effective fitting length) D1 of the movable-side arm portion 46 of the first contact 40 is set shorter than an arm length (effective fitting length) D2 of the movable-side contact portion 56 of the second contact 50 so as to make the effective fitting lengths of both thereof different from each other.

As described above, in this embodiment, the movable-side arm portion (contact portion) 46 of the first contact 40, which includes the movable-side contact point portion 46*a*, is equivalent to a contact portion in which an effective fitting length is short, and the movable-side arm portion (contact portion) 56 of the second contact 50, which includes the movable-side contact point portion 56*a*, is equivalent to a contact portion in which an effective fitting length is long.

Moreover, as shown in FIG. 1 and FIG. 2, through holes 63 are formed in the lever 60, so as to correspond to the spring portions 47 and 57, which are provided on the first contacts 40 and the second contacts 50, respectively. Moreover, on positions of the lever 60, which are adjacent to the through holes 63, the cam portion 64 is formed, which rotationally moves following the rotational movement of the lever 60 and is to be brought into sliding contact with the cam surfaces 47*a* and 57*a* provided on the spring portions 47 and 57.

In this embodiment, the cam portion 64 includes: a circular portion 64*a* with a substantially columnar shape; and a rectangular portion 64*b* with a substantially rectangular parallelepiped shape, which is provided continuously with the circular portion 64*a*.

In this embodiment, the cam portion 64 is formed into a substantially keyhole shape when a cross-section thereof is viewed in the front-back direction X.

Then, when the lever 60 is located at the open position, the cam portion 64 is elongated in the lateral direction (front-back direction X), and a dimension thereof in the vertical direction Z is set smaller than an interval between the spring portion 47 and terminal arm portion 45 of the first contact 40 and an interval between the spring portion 57 and terminal arm portion 55 of the second contact 50. That is to say, when the lever 60 is located at the open position, the cam portion 64 and the spring portions 47 and 57 are in a non-contact state with each other.

Meanwhile, when the lever 60 is rotationally moved in a closing direction, then on the way where the cam portion 64 rotationally moves so as to rise up, the dimension in the vertical direction Z of the cam portion 64 is made larger than the interval between the spring portion 47 and the terminal arm portion 45 and the interval between the spring portion 57 and the terminal arm portion 55.

Then, the spring portions 47 and 57 are configured to be elastically deflected so that an interval between a tip end of the spring portion 47 and a tip end of the terminal arm portion 45 and an interval between the spring portion 57 and the terminal arm portion 55 can be relatively increased.

Now, in this embodiment, the first contacts 40A are provided on both ends in the width direction Y of the housing 30, and the cable 20 inserted into the housing 30 is prevented from coming out by using the second contacts 50A arranged so as to adjoin the insides of the first contacts 40A on both ends concerned.

Specifically, notch-like holding holes (engagement portions) 22 open in the width direction X are formed on both ends in the width direction X of the cable 20 so as to penetrate the cable 20 in the thickness direction. The holding holes 22 are formed at regions, which correspond to the movable-side contact point portions 56*a* and fixed-side contact point portions 54*a* of the second contacts 50A arranged so as to be adjacent to the insides of the first contacts 40A on both ends in a state where the cable 20 is inserted into the housing 30.

Then, the movable-side contact point portions 56*a* formed on the movable-side arm portions (contact portions) 56 with a long effective fitting length of the movable-side arm portions (contact portions) 56 of the second contacts 50A arranged so as to adjoin the insides of the first contacts 40A on both ends, are engaged with the holding holes 22. At this time, with regard to the second contacts 50A arranged so as to adjoin the insides of the first contacts 40A on both ends, the fixed-side contact point portions 54*a* formed on the fixed-side arm portions (contact portions) 54 with a long effective fitting length, are also engaged with the holding holes 22. Note that, in a state where the lever 60 is located at the closed position, the movable-side contact point portion 56*a* and the fixed-side contact point portion 54*a* are engaged with the holding holes 22, and meanwhile, on the way of returning the lever 60 from the closed position to the open position, or in a state where the lever 60 is returned to the open position, such engagement with the holding holes 22 is released.

Figure 7:
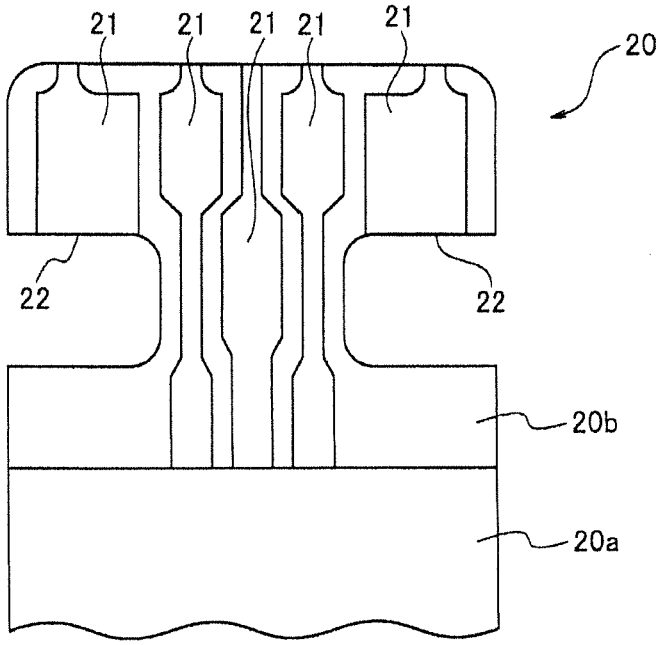
FIG. 7 is a plan view showing the cable according to the first embodiment of the present invention.
Figure 8:
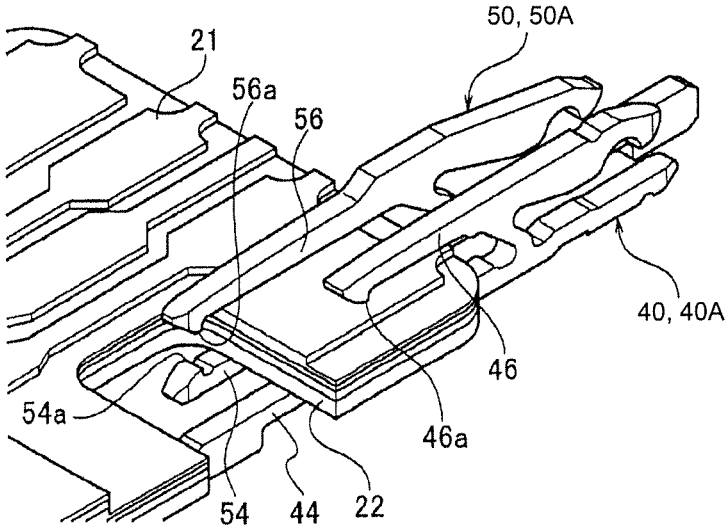
FIG. 8 is a perspective view showing an engaged state of the second contact and the cable according to the first embodiment of the present invention.

Moreover, in this embodiment, as shown in FIG. 7, with regard to the conductors 21 to be sandwiched by the movable-side contact point portions 46*a* and fixed-side contact point portions 44*a* of the first contacts 40A on both ends, electrical connection thereof to a conductor (not shown) formed in the inside of the body portion 20*a* is interrupted by the holding holes 22. Therefore, in this embodiment, the first contacts 40A on both ends are not used as contacts for signal transmission. That is to say, three contacts, which are: a center second contact 50 among the three second contacts 50; and two first contacts 40 among the four first contacts 40, are used as the contacts for the signal transmission.

Next, a description is made of operations of the first contacts 40 and the second contacts 50 when closing the lever 60.

First, in a state where the lever 60 is located at the open position, the cable 20 is inserted into the housing 30. Then, when the lever 60 is rotationally moved in a clockwise direction in FIG. 5, the cam portion 64 abuts on the cam surfaces 47*a* of the spring portions 47 and the cam surfaces 57*a* of the spring portions 57 to be brought into sliding contact with the cam surfaces 47*a* and 57*a*. Moreover, when the lever 60 is rotationally moved in the closing direction, the cam portion 64 elastically deflects the spring portions 47 and 57 so that the interval between the tip end of each spring portion 47 and the tip end of each terminal arm portion 45 and the interval between each spring portion 57 and each terminal arm portion 55 can be relatively increased.

Then, each coupling spring portion 43 is elastically deflected, following the deflection of the spring portion 47. As described above, by making the spring portion 47 and the coupling spring portion 43 deflected, the first contact 40 is elastically deflected so that the interval between the movable-side arm portion (contact portion) 46 of the movable-side contact portion 42 and the fixed-side arm portion (contact portion) 44 of the fixed-side contact portion 41 (that is, the interval is the distance between the movable-side contact point portion 46*a* and the fixed-side contact point portion 44*a*) can be reduced. That is to say, the movable-side contact point portion 46*a* moves in a direction of the fixed-side contact point portion 44*a*. As a result, the cable 20 is conductively connected to the first contacts 40 in a state of being crimped by the movable-side contact point portions 46*a* and the fixed-side contact point portions 44*a*.

Similar operations are also performed in the second contacts 50. That is to say, each coupling spring portion 53 is elastically deflected, following the deflection of the spring portion 57. Thus, by the deflection of the spring portion 57 and the coupling spring portion 53, the second contact 50 is elastically deflected so that the interval between the movable-side arm portion (contact portion) 56 of the movable-side contact portion 52 and the fixed-side arm portion (contact portion) 54 of the fixed-side contact portion 51 (that is, the interval is the distance between the movable-side contact point portion 56*a* and the fixed-side contact point portion 54*a*) can be reduced. That is to say, the movable-side contact point portion 56*a* moves in a direction of the fixed-side contact point portion 54*a*. As a result, in a state of being crimped by the movable-side contact point portions 56*a* and the fixed-side contact point portions 54*a*, the cable 20 is conductively connected to the second contacts 50.

At this time, the movable-side contact point portions 56*a* and fixed-side contact point portions 54*a* of the second contacts 50A arranged so as to adjoin the insides of the first contacts 40A on both ends are elastically deflected so that the interval therebetween can be reduced when the spring portions 57 and the coupling spring portions 53 are deflected. As a result, the movable-side contact point portions 56*a* and the fixed-side contact point portions 54*a* turn to a state of being inserted into the holding holes 22 from front and back surface sides of the cable 20. As a result, the movable-side contact point portions 56*a* and the fixed-side contact point portions 54*a* are engaged with the holding holes 22, so that the cable 20 inserted into the housing 30 is prevented from coming out.

In such a way, a connector assembly 100 is formed in which the cable 20 is engaged with the housing 30 of the connector 10.

As described above, in this embodiment, the first contacts 40A are arranged on both ends in the width direction Y of the housing 30, the holding holes (engagement portions) 22 are provided in the cable 20, and the movable-side contact point portions 56*a* (contact portions with a long effective fitting length) of the second contacts 50A arranged so as to adjoin the insides in the width direction Y of the first contacts 40A on both ends are engaged with the holding holes (engagement portions) 22.

Incidentally, in the case of alternately arranging, in the housing 30, the first contacts 40 having the contact portions with a short effective fitting length and the second contacts 50 having the contact portions with a long effective fitting length, then in general, the first contacts 40 having the contact portions with a short effective fitting length are arranged on both ends in the width direction Y. Therefore, it is conceivable to use the first contacts 40 having the contact portions with a short effective fitting length for preventing the cable 20 inserted into the housing 30 from coming out.

However, only by engaging the contact point portions of the contact portions with a short effective fitting length with the holding holes 22, cable holding force cannot be enhanced, and moreover, the holding holes (engagement portions) 22 must be formed on a front end side of the cable 20, resulting in a deterioration of machinability.

Therefore, it is conceivable to provide holding terminals, which have contact portions with a short effective fitting length, independently of the first contacts 40 and the second contacts 50; however, with such a configuration, the holding terminals are provided on both ends in the width direction Y of the housing 30, independently of the contacts, as mentioned above, so that the cost is increased by that amount.

As opposed to this, in this embodiment, the movable-side contact point portions 56*a* (contact portions with a long effective fitting length) of the second contacts 50A arranged so as to adjoin the insides in the width direction Y of the first contacts 40A arranged on both ends are engaged with the holding holes (engagement portions) 22. Therefore, it becomes unnecessary to provide the holding terminals independently of the contacts, and the cost can be reduced by that amount. Moreover, the contact portions (movable-side contact portions 56*a*) with a long effective fitting length are engaged with the holding holes (engagement portions) 22, and accordingly, the holding force of the cable 20 can be enhanced.

As described above, in accordance with this embodiment, there can be obtained: the connector 10 and the connector assembly 100, which are capable of preventing the cable 20 from coming out of the connector 10 while reducing the cost; and the cable 20 for use in the connector assembly 100.

Second Embodiment

Basically, a connector 10 according to this embodiment has a similar configuration to that of the above-described first embodiment.

That is to say, also in this embodiment, the connector 10 includes an insulative housing 30 into which a sheet-like cable 20A having a front surface and a back surface, such as an FPC and an FFC, is to be inserted.

Then, on an insertion end portion 20*b* continuously provided on a body portion 20*a* of the sheet-like cable 20A, a plurality of conductors 21 are exposed at a predetermined pitch in the width direction Y. Then, regions of the conductors 21, on which contact point portions (fixed-side contact point portions 44*a*, movable-side contact point portions 46*a*) of first contacts 40 and contact point portions (fixed-side contact point portions 54*a*, movable-side contact point portions 56*a*) of second contacts 50 are to abut, are arranged in a zigzag state in front and back two lines. Note that the conductors 21 are patterned on upper side and back side surfaces of the insertion end portion 20*b* so as to have substantially the same shape therebetween, and basically, are electrically connected to conductors (not shown) formed in the body portion 20*a*. Then, inside the housing 30, pluralities of the conductive first contacts 40 and second contacts 50, which are to be conductively connected to the conductors 21 of the cable 20A, are arrayed at a predetermined pitch in the width direction Y. The first contacts 40 and the second contacts 50 are alternately arranged in the width direction Y.

Moreover, an insulative lever 60 is rotatably attached to the housing 30.

Then, the first contacts 40A are arranged on both ends in the width direction Y of the housing 30, holding holes (engagement portions) 22A are provided in the cable 20A, and the movable-side contact point portions 56*a* (contact portions with a long effective fitting length) of the second contacts 50A arranged so as to adjoin the insides in the width direction Y of the first contacts 40A on both ends are engaged with the holding holes (engagement portions) 22A.

Here, a main point of difference of the connector 10 according to this embodiment from the connector 10 of the above-described first embodiment is that the holding holes (engagement portions) 22A are formed into a through hole shape.

Specifically, somewhat inner than both ends in the width direction X of the cable 20A, the holding holes (engagement portions) 22A, which are not open in the width direction X (that is, forming closed outlines when viewed from the above) are formed so as to penetrate the cable 20 in the thickness direction. The holding holes 22A are formed at regions, which correspond to the movable-side contact point portions 56*a* and fixed-side contact point portions 54*a* of the second contacts 50 arranged so as to adjoin the insides of the first contacts 40 on both ends in a state where the cable 20A is inserted into the housing 30.

Also in accordance with this embodiment described above, similar functions and effects to those of the above-described first embodiment can be exerted.

Figure 9:
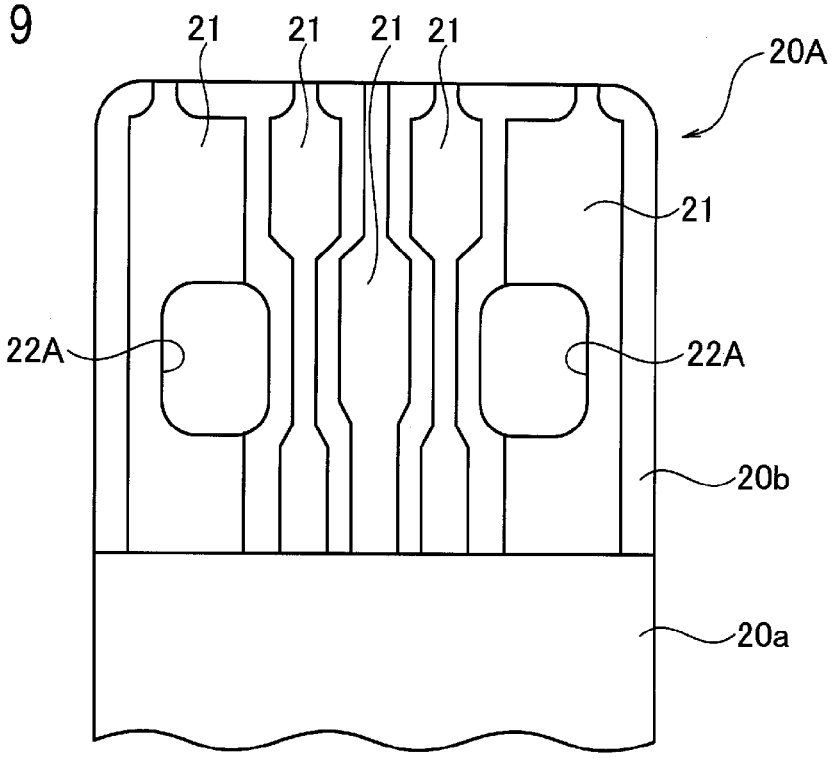
FIG. 9 is a plan view showing a cable according to a second embodiment of the present invention.
Figure 10:
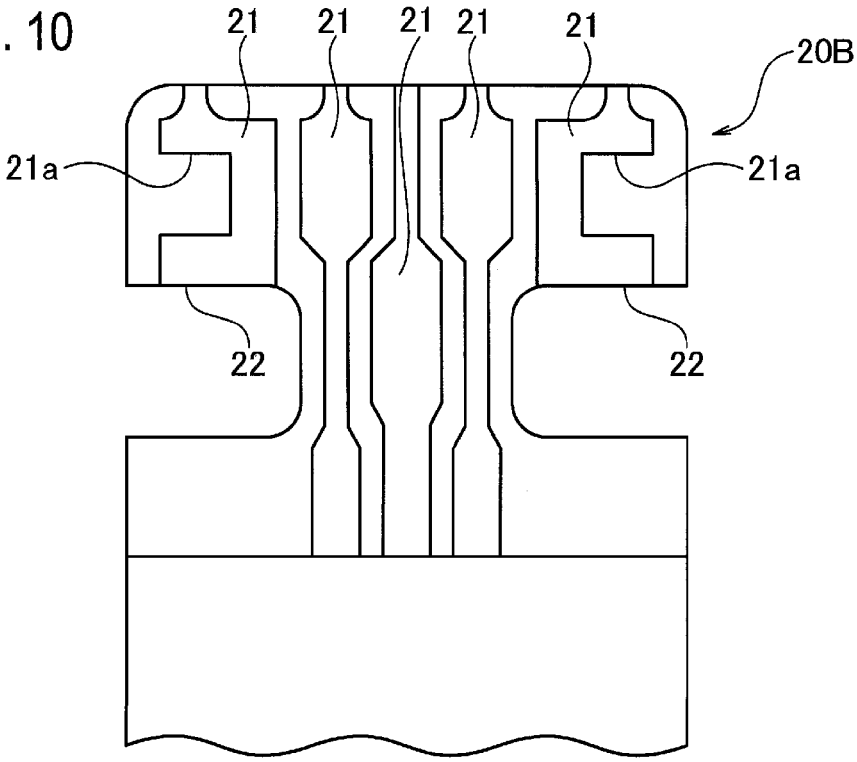
FIG. 10 is a plan view showing a cable according to a third embodiment of the present invention.
Figure 11:
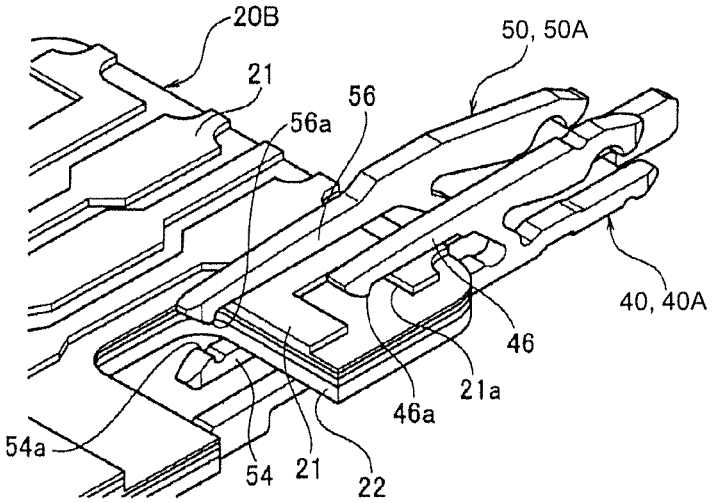
FIG. 11 is a perspective view showing an engaged state of a second contact and the cable according to the third embodiment of the present invention.

Moreover, in accordance with this embodiment, the holding holes (engagement portions) 22A, which engage with the movable-side contact point portions 56*a* (contact portions with a long effective fitting length) of the second contacts 50A arranged so as to adjoin the insides in the width direction Y of the first contacts 40A arranged on both ends, are formed into the through hole shape. Therefore, electrical connection of the conductors 21, to which the first contacts 40A arranged on both ends are to be conductively connected, to the conductor (not shown) formed in the inside of the body portion 20*a*, can be allowed not to be interrupted by the holding holes (engagement portions) 22A (refer to FIG. 9). Therefore, the first contacts 40A on both ends also become usable as the contacts for the signal transmission. At this time, with regard to the second contacts 50A arranged so as to adjoin the insides in the width direction Y of the first contacts 40A arranged on both ends, it is preferable to form insulating layers on at least surfaces thereof opposite to the conductors, and so on, so that the second contacts would not short circuit with the conductors 21 to which the first contacts 40A arranged on both ends are to be conductively connected.

Third Embodiment

Basically, a connector 10 according to this embodiment has a similar configuration to that of the above-described first embodiment.

That is to say, also in this embodiment, the connector 10 includes an insulative housing 30 into which a sheet-like cable 20B having a front surface and a back surface, such as an FPC and an FFC, is to be inserted.

Then, on an insertion end portion 20*b* continuously provided on a body portion 20*a* of the sheet-like cable 20A, a plurality of conductors 21 are exposed at a predetermined pitch in the width direction Y. Then, regions of the conductors 21, on which contact point portions (fixed-side contact point portions 44*a*, movable-side contact point portions 46*a*) of first contacts 40 and contact point portions (fixed-side contact point portions 54*a*, movable-side contact point portions 56*a*) of second contacts 50 are to abut, are arranged in a zigzag state in front and back two lines. Note that the conductors 21 are patterned on front and back surfaces of the insertion end portion 20*b* so as to have substantially the same shape therebetween, and basically, are electrically connected to conductors (not shown) formed in the body portion 20*a*. Then, inside the housing 30, pluralities of the conductive first contacts 40 and second contacts 50, which are to be conductively connected to the conductors 21 of the cable 20B, are arrayed at a predetermined pitch in the width direction Y. The first contacts 40 and the second contacts 50 are alternately arranged in the width direction Y.

Moreover, an insulative lever 60 is rotatably attached to the housing 30.

Then, the first contacts 40A are arranged on both ends in the width direction Y of the housing 30, the holding holes (engagement portions) 22 are provided in the cable 20A, and the movable-side contact point portions 56*a* (contact portions with a long effective fitting length) of the second contacts 50A arranged so as to adjoin the insides in the width direction Y of the first contacts 40A arranged on both ends are engaged with the holding holes (engagement portions) 22.

Here, a main different point of the connector 10 according to this embodiment from the connector 10 of the above-described first embodiment is that step difference portions 21*a* are provided on the conductors 21 formed in the cable 20B.

Figure 12:
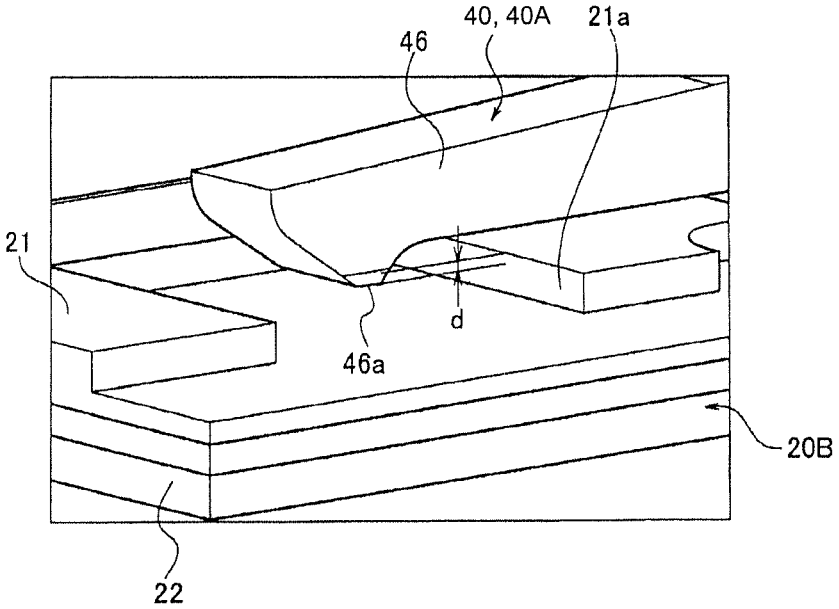
FIG. 12 is a perspective view enlargedly showing an engaged state of a first contact and a conductor according to the third embodiment of the present invention.

Then, the movable-side contact point portions 46*a* (contact portions with a short effective fitting length) of the first contacts 40A arranged on both ends are engaged with the step difference portions 21*a*. In this embodiment, as shown in FIG. 12, design is made so that each of the movable-side contact point portions 46*a* of the first contacts 40A can overlap the conductor 21 by a thickness d with the cover closed, whereby the movable-side contact point portion 46*a* is engaged with the step difference portion 21*a*.

Note that the step difference portions 21*a* are formed also on the conductors 21 on an opposite side of the cable 20B, and the fixed-side contact point portions 44*a* (contact portions with a short effective fitting length) are engaged with the step difference portions 21*a*. The step difference portions 21*a* may be formed on the conductors 21 on either one of the front and back surfaces of the cable 20B.

In this embodiment, the step difference portions 21*a* are formed by partially removing the conductors 21 patterned on the front surface of the cable 20B.

Also in accordance with this embodiment described above, similar functions and effects to those of the above-described first embodiment can be exerted.

Moreover, in accordance with this embodiment, the step difference portions 21*a* are provided on the conductors 21 formed on the cable 20B, and the movable-side contact point portions 46*a* (contact portions with a short effective fitting length) of the first contacts 40A arranged on both ends are engaged with the step difference portions 21*a*. Therefore, the holding force of the cable 20 can be further enhanced.

The description has been made above of the preferred embodiments of the present invention; however, the present invention is not limited to the above-described embodiments, and is modifiable in various ways.

For example, it is possible to appropriately change specifications (shapes, sizes, layout and the like) of the housing, the lever, the cam portion, and other details.

What is claimed is:

1. A connector comprising:

a housing into which a cable is to be inserted;

first contacts housed in the housing and having contact portions with a short effective fitting length in a cable insertion/removal direction; and second contacts housed in the housing and having contact portions with a long effective fitting length in the cable insertion/removal direction, wherein the first contacts are arranged on both ends in a width direction of the housing, engagement portions are provided on the cable, and the contact portions with the long effective fitting length of the second contacts arranged so as to adjoin insides in the width direction of the first contacts arranged on both ends, are engaged with the engagement portions.

2. The connector according to claim 1, wherein the first contacts and the second contacts are alternately arranged in the width direction of the housing.

3. The connector according to claim 1, wherein step difference portions are provided on conductors formed in the cable, and the contact portions with the short effective fitting length of the first contacts arranged on both ends, are engaged with the step difference portions.

4. The connector according to claim 1, wherein the engagement portions are through holes or notches.

5. The connector according to claim 3, wherein the conductors are patterned on a front surface of the cable, and the step difference portions are formed by partially removing the patterned conductors.

6. A connector assembly, wherein the cable on which the engagement portions are formed is inserted into the housing of the connector according to claim 1.

7. A cable to be used in the connector assembly according to claim 6.

* * * * *